United States Patent [19]

Niedermeyer

[11] 4,309,157

[45] Jan. 5, 1982

[54] PROTECTION DEVICE AND SUMP PUMP

[76] Inventor: Karl O. Niedermeyer, 17WO68 North St., Bensenville, Ill. 60106

[21] Appl. No.: 16,295

[22] Filed: Mar. 1, 1979

[51] Int. Cl.[3] ..... H01H 35/18

[52] U.S. Cl. ..... 417/421; 200/83 R; 200/84 B

[58] Field of Search ..... 73/301, 308, 313, 322.5; 417/410, 421, 422, 424, 426; 137/404; 340/618, 626; 200/61.2, 81 R, 82 R, 83 R, 84 R, 84 B, 81.4, 81.5

[56] References Cited

U.S. PATENT DOCUMENTS

| | | | |
|---|---|---|---|
| 2,918,016 | 12/1959 | Olson | 417/421 |
| 3,130,023 | 4/1964 | Hasselberg | 137/404 |
| 3,992,130 | 11/1976 | Childress | 200/81 R |
| 4,087,663 | 5/1978 | Sawyer | 200/84 R |

*Primary Examiner*—Gerald P. Tolin

*Attorney, Agent, or Firm*—Howard H. Darbo; Edward C. Vandenburgh

[57] ABSTRACT

A protection column is employed about a sump pump to exclude liquid and foreign matter in the sump from entering the pump interior until a time just prior to priming and activation of the pump. The column has a closed bottom portion serving as a vessel and permitting the column to float as the liquid level rises in the sump. The upper part of the column fits about the pump to act as a guide and has a series of vertical slots. The column floats until the bottom of the column strikes the bottom of the sump pump, which prevents the column from rising further. As the water level continues to rise in the sump, water enters the column through the slots, causing the column to sink to the bottom of the sump and permitting the liquid to rise to a level in the pump commensurate with the level elsewhere in the sump, thereby priming the pump.

9 Claims, 1 Drawing Figure

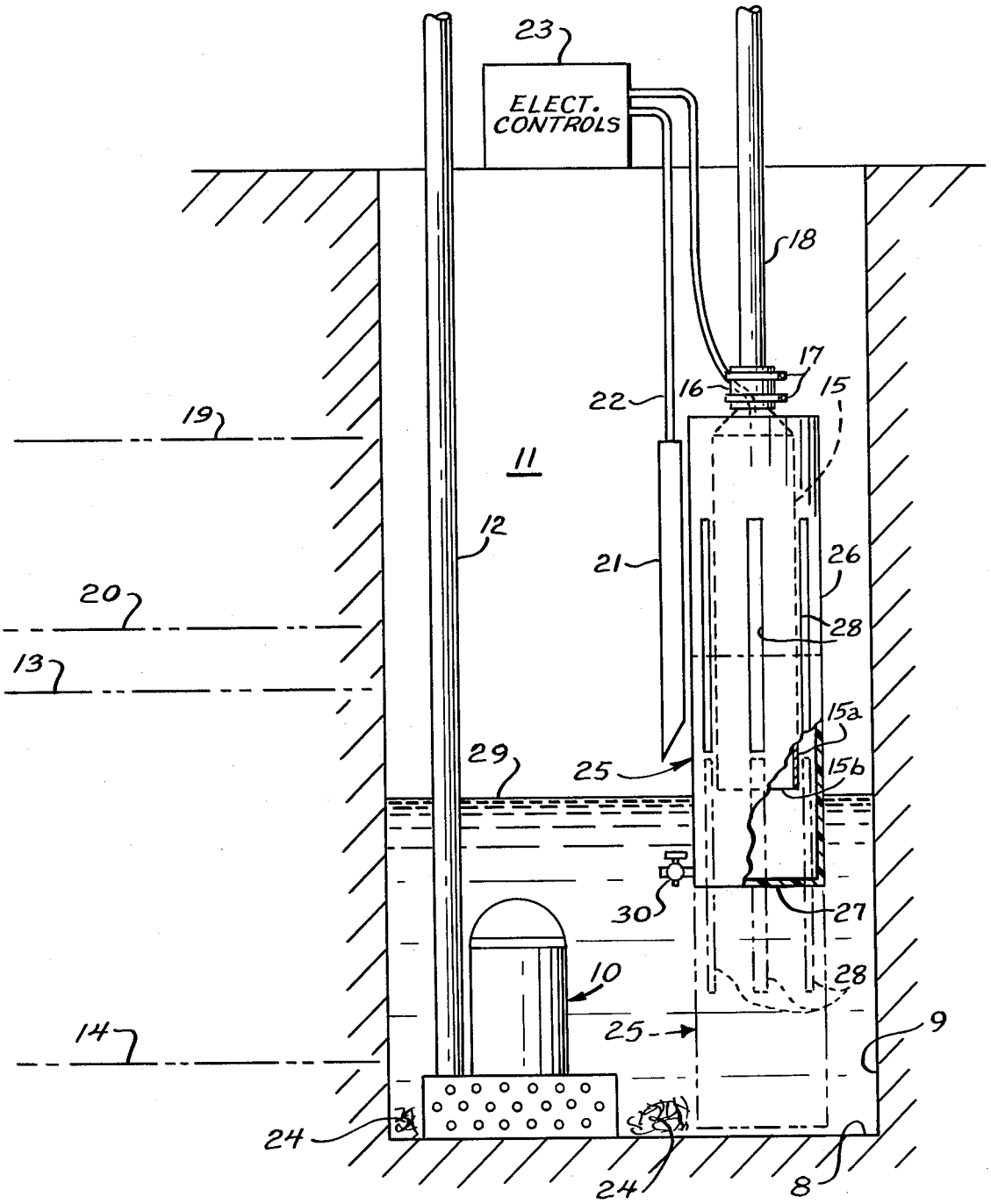
23
ELECT. CONTROLS
18
17
16
15
22
19
11
12
21
26
20
28
13
15a
29
25
15b
30
27
10
28
14
25
9
24
24
8

PROTECTION DEVICE AND SUMP PUMP

BACKGROUND AND SUMMARY OF THE INVENTION

The present invention relates to backup, or secondary, sump pumps which are battery powered and used to evacuate the water from the sump in the event of an emergency caused by failure of a primary sump pump. In particular, the invention relates to a protection device or column which maintains the backup sump pump free of debris and dry until the backup sump pump is needed to evacuate water from the sump.

A primary sump pump normally is powered from an electrical line bringing power from a remote power station. Often, especially in more rural areas, due to failure of power in the electrical lines during a storm, the primary pump will not be operative. At that time, the battery powered backup pump takes over the task of removing water from the sump.

Obviously, due to their nature, such backup pumps operate only infrequently. Yet, normally they will be located in the sump where they are alternately submerged in water and then free of water as the water level in the sump goes up and down as a result of the action of the primary pump. This constant bathing of the pump components and then exposing them to air can be particularly hard on the pump components and the mechanical operating condition of the pump, especially when the pump is normally standing idle, corrosively impairing pump operation and dramatically shortening its useful life. Furthermore, the water moving into and out of the backup sump pump is likely to carry with it contaminates and debris which are deposited on and in that pump or its pump screen, further impairing its operating condition. Since it is not uncommon for a power failure to occur as the result of a storm, the backup pump may become inoperative at just the very time it is needed most.

Therefore, the principal purpose of the present invention is to provide a protection device for a backup sump pump apparatus to exclude water, and any contaminates that it may carry, from the operating components of the pump during its period of inaction. There therefore will be less opportunity for those operating components to be so deleteriously affected that the pump will fail to operate when it is needed.

In accordance with the invention, the protection device for the backup sump pump apparatus is composed of an elongated, hollow guard column which surrounds the pump unit of the sump pump apparatus. The bottom portion of the guard column is closed to form a buoyant vessel, permitting the column to float as the liquid level rises in the sump. A series of openings in the form of vertical slots are located in the guard column extending upwardly from a short distance above the water line to a short distance from the top of the column. This upper part of the column fits about the pump unit to thereby guide the guard for aligned vertical movement. When liquid rises to an abnormal elevation in the sump, the bottom of the guard column strikes the bottom of the pump unit, preventing the guard column from rising any further within the sump. As the liquid level then continues to rise in the sump, liquid enters the guard column through the openings, causing the guard column to sink to the bottom of the sump and allowing the pump to be primed for subsequent pumping operation.

BRIEF DESCRIPTION OF THE DRAWING

The drawing illustrates an embodiment in elevation, which embodiment is located in a sump, depicted in section.

DESCRIPTION OF THE PREFERRED EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

A conventional sump pump, shown generally at 10, is employed in a sump 11 to remove liquid, e.g., water, which may collect therein. For example, the basements of homes or commercial establishments may have such sumps to collect water for removal and thereby keep the basements dry. A discharge pipe 12 is connected to the pump so that the water to be removed can be conducted to an appropriate location for discharge. Such pump has controls (not illustrated) so that, for example, the pump is energized when the level of the water in the sump reaches that indicated by line 13 and the pump is turned off after it has extracted sufficient liquid from the sump to lower the liquid level to the line 14. The sump is formed by fixed components, such as bottom 8 and side walls 9.

As a result of the fact that the primary sump pump may occasionally fail to operate, many users of sump pumps will also employ a secondary or backup sump pump unit, especially when vital records and other documents and materials are located in the vicinity of the sump, such as those records in a basement bank vault. The backup sump pump unit is designated at 15 and includes a housing **15*a* within which a battery powered electric motor is connected to an impeller (neither the motor nor impeller being illustrated) positioned to pump water upwardly from the sump 11. The bottom 15*b* of the housing is open to permit water to enter to reach the impeller and this is the only opening other than that at the top for the connection to a discharge conduit 18. The sump pump 15 is connected by means of a flexible hose 16 and hose clamps 17 to the discharge conduit 18. Mounting means, not shown, fixedly position the pump unit in the sump. The arrangement of the backup sump pump 15 is such that when the motor of the pump is energized, the pump draws liquid out of the sump and discharges it from the sump through the conduit 18**. Further details of such a pump are illustrated and described in my copending U.S. Pat. application Ser. No. 793,402, filed May 3, 1977, and entitled "Through Flow Sump Pump", now Pat. No. 4,177,021, the disclosure of which is incorporated herein by reference.

Such a secondary pump is not intended to operate constantly, but only in the event that the primary pump 10 fails to keep the liquid level in the sump down to the lower portion thereof. Thus, for example, the controls of the secondary pump unit 15 will be set so that the pump unit will be energized when the liquid level in the sump reaches that indicated by the line 19 and will turn the pump unit off when the liquid level drops to that indicated by the line 20.

One such control for providing a differential in the liquid level between the point at which the motor of the pump unit 15 turns on and turns off is described in my copending U.S. Pat. application Ser. No. 891,213, filed Mar. 29, 1978, and entitled "Air Pressure Switch Signaling Two Different Pressure Conditions", now abandoned, the disclosure of which is incorporated herein by reference. As shown in part in the drawing of the present invention, it comprises a bell 21 which is suspended with its open end down and which communicates through a hose or tube 22 to a fluid pressure actuator (not illustrated) located in an electrical control device 23. As water rises above the open end of the bell 21, air pressure builds up in the bell, which pressure is transmitted through the hose 22 to the actuator in the electrical control device 23, energizing the backup sump pump 15. The same differential water level/-switch actuation can be achieved with float switches, as for example that described in my U.S. Pat. No. 4,086,457, issued Apr. 25, 1978, the disclosure of which is also incorporated herein by reference.

With an arrangement as thus far described, it will be noted that as the liquid level in the sump varies between the liquid level limits defined by the lines 13 and 14 (resulting from operation of the primary pump 10) the liquid will correspondingly go up and down in the pump 15, unless excluded therefrom. This repeated bathing of the parts within the secondary pump 15 and then exposing them to air as the water level rises and falls can have a deleterious effect upon the backup pump unit. Also, debris such as that indicated at 24 may get past the screen of the pump and work into the pump where it can have a further deleterious effect. Obviously, the backup pump unit 15 was put into the sump to provide protection in the event of an emergency and should the pump 15 fail to operate when required, its purpose has not been fulfilled. Therefore, included as a part of the invention is a protection device, generally designated at 25, to protect the backup pump 15 to provide additional assurance that it will operate when necessary.

As shown in the drawing, the protection device 25 consists of an elongated guard column or cylinder 26 which is hollow and which surrounds the pump unit 15. The top of the column 26 is open, while the bottom 27 of the column is sealed. The closed bottom portion of the guard, i.e., that below the bottom of slots 28, is a vessel and displaces more than enough water to offset the weight of the guard so that the guard is buoyant. Thus the column floats and protects the backup pump 15 by keeping it dry as the liquid level rises in the sump 11 under normal conditions between level limits defined by the lines 13 and 14. The column 26 is sufficiently tall so that even when the bottom 27 rests on the bottom of the sump, as shown in phantom, a portion of the column will surround part of the backup pump 15, thus preventing the column from inadvertently being removed from the pump when the sump is low or empty. The upper part of the column, i.e., that part above the bottom of slots 28, primarily serves as a guide about the fixedly mounted pump unit 15 and maintains the vessel portion in alignment with the pump unit.

The column 26 also includes a series of passages, shown as slots 28, intermediate the top and bottom thereof for providing an inlet through which liquid can flow from the exterior into the interior of the column. The slots 28 extend vertically in the column 26 from a short distance above the water line, shown at 29, to prevent the column 26 from sinking under normal conditions. With the use of relatively narrow slots, the column will serve also as a screen to prevent debris from getting to the pump after the column has moved to the position illustrated in dashed lines. If such debris causes a lower portion of the slot to plug up, the rising water in the sump will flow into the guard through the part of the slot below or above the location at which that obstruction exists. Obviously, apertures of shapes other than slots, e.g., a large number of variously placed round openings may be employed. A petcock 30 may be located at the bottom of the column 26 to permit draining of the interior of the column in that area below the bottom of the slots 28 after the column has become filled with liquid.

As indicated above, normally the primary pump 10 will be operational and the water level 29 will vary between limits depicted by the lines 13 and 14. The protection device 25 will float up and down about the backup pump 15 as the water level varies between its high and low limits. If the primary pump 10 fails to operate, adverse conditions may cause the liquid level to rise above that indicated by the line 13, and the protection device 25 correspondingly continues to float with the liquid level as it rises. When the liquid level has risen to a sufficient height, the bottom 27 of the column 26 strikes the bottom of the pump housing **15*a*. Thus the bottom 27 serves as a stop on the column. Therefore, the protection device is prevented from rising further with respect to the pump unit 15. The lowermost portion of the slots form passages between the exterior and interior of the column and as the liquid level then rises even further, liquid begins to pour into the column 26 through those passages. This occurs before the liquid reaches the level 19 at which the pump turns on. When a sufficient quantity of liquid has entered the bottom vessel portion of column 26 to overcome its buoyancy, it sinks to the bottom of the sump 11 to the position indicated in dashed lines in the drawing. Now the liquid can enter the pump through the slots 28 and the open bottom 15*b* of the pump unit to rise within the pump unit 15 to a level corresponding to that of the then-existing liquid level in the sump. This will prime the pump. As the liquid continues to rise in the sump and reaches the level indicated by the line 19, the electrical control device 23 actuates the pump unit 15 to begin discharge of liquid from the sump 11. When the liquid level in the sump drops to that indicated by the line 20, the electrical control device 23 deenergizes the backup sump 15, allowing the liquid level to again rise to the line 19** for the pumping procedure to be repeated.

Preferably, and as described in greater detail in my copending U.S. Pat. application Ser. No. 969,065, filed Dec. 13, 1978, and entitled "Sump Pump With Air Column Therein When Pump Is Not Operating", a light or audible alarm is connected to the electrical control device 23 and placed at a strategic location within the building in which the sump 11 is located so that when the backup pump 15 is actuated, the light or other alarm is also actuated to apprise the occupants of the building that the primary pump 10 has failed and that the secondary pump 15 has assumed the protective role of eliminating water from the sump 11. Presumably the occupants of the building will now take action to remedy the failure of the primary pump 10.

After the primary pump 10 is put back into operation, it will commence withdrawing liquid from the sump. As the liquid level drops below that indicated by the line 20, the backup pump 15 will no longer be needed. The building occupant may then grasp the protection device 25 and raise it above the water level 29, and open the petcock 30 to drain any surplus liquid contained within the column 26. The petcock 30 is then closed and the protection device returned into the liquid to again float with the liquid level and protect the backup pump 15 until the primary pump 10 has again failed. Alternatively, the petcock 30 can be omitted, and the column 26 may be evacuated when elevated about the pump 15 by energizing the pump 15 for a short burst sufficient to clear the interior of the column 26 below the slots 28. Also it is possible to remove the water from the guard by raising the pump unit 15 sufficiently to permit the guard 25 to fall away from the pump unit, then emptying the guard before replacing it on the pump unit in the sump as illustrated.

In the drawing, the secondary pump unit 15 has been illustrated at a particular elevation above the bottom of the sump 11. While the particular location of the backup pump 15 is unimportant so long as in an emergency it is operated to prevent liquid from flowing from the sump 11, the height of the column 26 must be always maintained greater than that of the elevation of the bottom of the pump 15 above the bottom of the sump 11 or above a support (e.g., a cement block) resting on the bottom of the sump. As an alternative, the protection device 25 could be suspended from an overhead support by chains or flexible cords in a manner such that it could not fall away from the pump unit 15 when there was little or no water in the sump, yet could move up and down with higher water elevations. Also, the maximum water level attained when the primary pump 10 is operating normally must be below the level of the bottom of the slots 28 when the guard 25 is abutting the bottom of the pump unit 15. Various parameters, including sump size and configuration, will dictate where the backup pump 15 is to be located within the sump 11, and therefore the necessary minimum height of the column 26.

I claim:

1. The combination of a protection device and a sump pump apparatus or the like, said pump apparatus being positioned in a liquid-containing sump in which there is a fixed component such as the walls of the sump, in which sump variations occur in the liquid level, the pump apparatus comprising a pump component suspended with its bottom above the bottom of the sump and control means to turn the pump component on after the liquid level has risen to a sufficiently high elevation to prime the pump component, said combination comprising:

a vessel having an interior opening extending downwardly from the top thereof, the horizontal dimensions of said opening being sufficiently large so that said vessel will fit about the bottom of the pump component, said vessel having a "water line" below the top of the vessel so that the vessel will float in the liquid in the sump, said vessel having a liquid passage from the exterior to the interior of the vessel with at least a portion of said passage being above said water line whereby with said vessel floating normally the liquid will not traverse said passage, said vessel forming at least part of said device; and guide means engaging the vessel and for engaging a first of said components for aligning said vessel below said pump component with said interior opening aligned to receive the bottom of the pump component, whereby as said liquid level increases said vessel will rise about the bottom of the pump component and prevent the liquid from entering the bottom of the pump component;

said vessel having stop means aligned for engaging one of said components after said liquid has risen to an upper elevation sufficient to position said vessel about the bottom of the pump component for preventing said vessel from rising further with respect to the pump component, said upper elevation being below said sufficiently high elevation, said portion of said passage being above the liquid level when the liquid level is at said upper elevation and below the liquid level when the liquid level is at said sufficiently high elevation, whereby before said liquid reaches said sufficiently high elevation the liquid will flow through the passage and into the vessel causing the vessel to sink away from the bottom of the pump component whereupon the liquid can enter the pump component.

2. A combination as set forth in claim 1 in which said vessel comprises an elongated, hollow guard means having a sealed bottom.

3. A combination as set forth in claim 2 in which said passage comprises at least one slot in said guard means located above said "water line".

4. A combination as set forth in claim 2 in which said guard means is cylindrical.

5. A combination according to claim 2 in which said stop means comprises said sealed bottom for engaging the bottom of said pump component to prevent said vessel from rising further with respect to the pump component.

6. A combination as set forth in claim 1 in which said pump component is suspended a particular distance above the bottom of the sump, and the height of said vessel is greater than said particular distance to achieve alignment of said pump component and said vessel.

7. A combination as set forth in claim 1 in which said guide means comprises an upper portion of said vessel receiving the bottom of said pump component.

8. A combination as set forth in claim 1 in which said stop means comprises the bottom of the interior opening of said vessel.

9. A combination as set forth in claim 1 including a petcock located at the bottom of said vessel to permit draining of liquid from said interior opening of the vessel.

* * * * *